US010363993B2

(12) United States Patent
Dalrymple Smith

(10) Patent No.: US 10,363,993 B2
(45) Date of Patent: Jul. 30, 2019

(54) RETRACTABLE WING

(71) Applicant: SEABUBBLES, Paris (FR)

(72) Inventor: Terrot Dalrymple Smith, La Ciotat (FR)

(73) Assignee: SEABUBBLES, Paris (FR)

( * ) Notice: Subject to any disclaimer, the term of this patent is extended or adjusted under 35 U.S.C. 154(b) by 0 days.

(21) Appl. No.: 15/540,043

(22) PCT Filed: Sep. 2, 2015

(86) PCT No.: PCT/FR2015/052319

§ 371 (c)(1),
(2) Date: Jun. 27, 2017

(87) PCT Pub. No.: WO2016/034814

PCT Pub. Date: Mar. 10, 2016

(65) Prior Publication Data

US 2017/0355424 A1 Dec. 14, 2017

(30) Foreign Application Priority Data

Sep. 3, 2014 (FR) ..... 14 58227

(51) Int. Cl.
*B63B 1/30* (2006.01)
*B63B 1/26* (2006.01)
*B63B 1/28* (2006.01)

(52) U.S. Cl.
CPC ..... *B63B 1/30* (2013.01); *B63B 1/26* (2013.01); *B63B 1/285* (2013.01)

(58) Field of Classification Search
CPC .... B63B 1/16; B63B 1/26; B63B 1/28; B63B 1/285; B63B 1/30
USPC ..... 114/282
See application file for complete search history.

(56) References Cited

U.S. PATENT DOCUMENTS

| | | | | |
|---|---|---|---|---|
| 3,200,781 A | | 8/1965 | Takagi | |
| 3,241,511 A | | 3/1966 | Drtina | |
| 3,613,622 A | | 10/1971 | Bueller | |
| 4,056,074 A | | 11/1977 | Sachs | |
| 5,373,800 A | * | 12/1994 | Steinberg | B63B 1/30 114/282 |

FOREIGN PATENT DOCUMENTS

| | | |
|---|---|---|
| GB | 1120612 | 7/1968 |
| JP | 4653255 | 3/2011 |
| WO | WO 2011/157658 | 12/2011 |

OTHER PUBLICATIONS

International Search Report for PCT/FR2015/052319 dated Oct. 16, 2015, 2 pages.

* cited by examiner

*Primary Examiner* — Lars A Olson
(74) *Attorney, Agent, or Firm* — Dority & Manning, P.A.

(57) ABSTRACT

The invention relates to a retractable wing equipping a watercraft. The wing includes a first support upright, a first end of which engages with the hull of the watercraft and a second end of which supports a first hydrofoil. The wing is characterized in that the first hydrofoil and first support upright engage with one another by way of an articulated connection having a degree of freedom in rotation about an axis perpendicular to a longitudinal axis passing through the ends of the first support upright, allowing the hydrofoil to fold parallel to the longitudinal axis.

14 Claims, 7 Drawing Sheets

RETRACTABLE WING

CROSS-REFERENCE TO RELATED APPLICATIONS

The present application is the national stage entry of International Parent Application No. PCT/FR2015/052319 having a filing date of Sep. 2, 2015, which claims priority to French Patent Application No. 1458227 filed on Sep. 8, 2014, which are incorporated herein in their entirety by reference thereto.

BACKGROUND OF THE INVENTION

The invention relates to the field of load-bearing wings, also known by the English term "hydrofoil", fitted to watercraft. More particularly the invention relates to a retractable load-bearing wing. By "retractable load-bearing wing" is meant any load-bearing wing which can be folded back in such a way that it does not cause any significant increase in the maximum beam of a floating member or hull of a watercraft incorporating such a load-bearing wing.

A load-bearing wing or hydrofoil is a device capable of raising a floating member, also referred to below as a hull, of a watercraft partly or wholly out of the water under one effect of hydrodynamic lift generated on its load-bearing plane by the speed at which the watercraft moves. Because lift is transferred from the hull to the load-bearing plane of the load-bearing wing this device thus makes it possible to reduce drag, that is to say reduce the contact friction between the watercraft and the water, in particular waves. The reduction in drag then makes it possible to reduce the power necessary to achieve a high cruising speed, and therefore to make substantial savings, in particular in terms of fuel consumption.

In the remainder of the description the terms "load-bearing wing" and "hydrofoil" will be used indiscriminately to refer to the same device.

Load-bearing wings are particularly suitable for all watercraft, particularly motorboats of small size, powerboats or even luxury vessels such as, by way of non-limiting examples, yachts. In principle they can be fitted to all kinds of sailing and/or motorboats, single or multihulls or even motor-driven watercraft such as, by way of non-limiting examples, jet skis.

There are different configurations of load-bearing wings. These are classified into two main families: variable surface load-bearing wings which pierce the surface, such as the oblique or "V"-shaped load-bearing wings for example, and load-bearing wings having a constant immersed surface such as upside-down "T"- or "L"-shaped, or even upside-down and "Y"- or "U"-shaped or curved load-bearing wings.

In the case of load-bearing wings which pierce the surface the lift from the wing is proportional to the immersed surface area. Speed compensates for loss of surface area. For a given speed the boat will rise until the lift from the load-bearing plane is equal to the weight applied to said load-bearing plane. Lift is therefore constant, and is said to be self-regulated.

In the case of immersed load-bearing wings the load-bearing surface is wholly immersed at all times. Lift does not vary with the height of rise. Such a configuration is particularly advantageous because of its ability to isolate the boat from the effect of waves. On the other hand this configuration is not naturally stable as regards ride height, pitch and roll. Because of this a load-bearing wing of such type is generally fitted with a stabilizer system. In order to provide stability at any speed the rise height of the load-bearing wing must be capable of being controlled. In order to do this it is suitable to vary the lift coefficient of the load-bearing plane. The stabilizer system thus makes it possible to adjust the angle of incidence, also known as the angle of attack, of the load-bearing plane so as to vary the load-bearing capacity in relation to speed, weight or sea conditions. The stabilizer system may be implemented in different ways, for example by varying the angle of incidence by pivoting the load-bearing plane to incline the leading edge to a greater or lesser extent in relation to the trailing edge, or by using one or more flaps on the trailing edge of the load-bearing plane to make it mobile, or any other similar device for controlling lift.

Load-bearing wings are mounted beneath the hull that they have to support. They nevertheless have a number of disadvantages because of their bulk. Thus a boat fitted with such load-bearing wings is not able to sail at slow speed in shallow water. Mooring alongside a quay or a pontoon is complicated and hazardous, particularly when the load-bearing wing extends beyond the maximum beam of the boat. A boat fitted with load-bearing wings is therefore only able to moor alongside a quay that is intended for it, its vertical wall being inclined so as to be able to allow room for lateral load-bearing wings. In order to prevent them from extending beyond the hull of the boat some load-bearing wings are mounted in a central slot and pass through the hull of the boat vertically, and the height to which they penetrate through the hull varies in relation to the rise height. Such load-bearing wings are for example fitted to the AC72 catamaran designed in 2012 and used in the Americas Cup in 2013. However in the latter case the load-bearing wings generally have a curved profile and the possibilities for constructing profiles of different shape are limited because they are detrimental to the performance and/or cost of the load-bearing wing.

Because the large dimensions of load-bearing wings make mooring in particular very difficult, solutions for retracting them to reduce their dimensions have been envisaged in the past.

Thus document U.S. Pat. No. 7,984,384 describes one solution for retracting a hydrofoil of the immersed type, particularly in the passages in its description on pages 174 and 175 describing FIGS. 398 and 399. The solution described in this document consists of constructing a load-bearing wing which retracts telescopically. In order to do this the support leg of the load-bearing wing slides towards the hull within a sheath, box or slide system referenced 4004*a* in the document. This sheath system is located within the hull of the boat, which makes it necessary to adjust the boat's hull to a particular configuration of the load-bearing wing. The immersed load-bearing plane comprises a fixed portion located beneath the hull and a retractable portion 4011 which extends beyond the maximum beam of the hull and is capable of sliding within an element 4005 towards the fixed portion 4010 located beneath the hull. Although this system makes it possible to retract a load-bearing wing, it cannot retract it completely so that the boat has the appearance of being without a load-bearing wing. The telescopic retraction system described appears to be complex to construct and requires the hull of the boat to be altered in order to be able to incorporate it. Such a system cannot therefore be easily used on any boat and also cannot be applied to any configuration of load-bearing wing.

Document WO1993/04909 describes a system for damping out the impacts experienced by load-bearing wings, the system applying to both fixed and retractable load-bearing wings. The mechanism for retraction of the load-bearing wing described in this document comprises a motor-driven system rotating an endless screw which engages in a groove provided in the upper surface of the load-bearing wing, while one spherical end of the impact absorption system engages in a groove provided in the opposite surface of the load-bearing wing to cause it to pivot backwards. The angle of retraction is thus controlled by the impact absorption system. The load-bearing wing then pivots and retracts within the hull through a slot made in the hull. This document describes a complex retraction system which again makes it necessary to adapt and modify a boat/s hull and is not able to adapt to all configurations of load-bearing wings. Such a solution is therefore still too complex and costly to be implemented.

Document US 2009/0013917 describes another solution for retracting a load-bearing wing of the immersed type. This solution consists of sliding each support leg supporting a load-bearing plane along a groove formed in the surface of the load-bearing plane on the one hand and along another channel formed in a housing provided beneath the hull of the boat, by means of a piston. The load-bearing plane and the support leg then nest in the housing provided beneath the hull. A vertical guide bar attached beneath the boat's hull acts as a guide when the load-bearing wing is being retracted. This solution also appears to be complex to implement because it requires modification of the boat's hull. It cannot therefore be easily implemented for any type of boat, nor for any configuration of load-bearing wing. Furthermore the presence of the guide bar makes it impossible to reduce the boat's draft.

Other documents such sis documents U.S. Pat. No. 3,241,511, 3,236,202 or 3,044,432 also provide solutions for retracting load-bearing wings that are also based on movements of a telescopic or parallelogram type. Such solutions are complicated and costly to implement, require modifications to boat hulls and cannot always be adapted to all load-bearing wing configurations.

As a consequence the existing solutions are unsatisfactory. In fact although they make it possible to shorten a load-bearing wing, by sliding its constituent elements, which nest and slide within each other, these solutions all require changes in the hull of the watercraft and are not appropriate for all load-bearing wing configurations.

BRIEF SUMMARY OF THE INVENTION

The object of the invention is therefore to wholly or partly remedy the disadvantages of the prior art. In particular the object of the invention is to provide an alternative solution to the existing solutions for retractable load-bearing wings, which is of simple design, allowing the load-bearing wing to be easily and quickly retracted in such a way that it does not give rise to any significant increase in the maximum beam of the hull and thus makes mooring a watercraft easier, while being suitable for all types of existing hulls without any need to modify them and being capable of being applied to any configuration of load-bearing wing, whether of the piercing or immersed type.

For this purpose the invention relates to a retractable load-bearing wing fitted to a watercraft, said load-bearing wing comprising a first support leg, a first end of which acts together with the hull of the watercraft and a second end of which supports a first load-bearing plane. In order that such a load-bearing wing can be retracted when required said first load-bearing plane and said first support leg act together through an articulated connection having a degree of freedom in rotation about an axis perpendicular to a longitudinal axis passing through said ends of said first support leg, enabling said load-bearing plane to fold parallel to said longitudinal axis.

Thus the dimensions of the load-bearing wing are reduced to the sum of the thicknesses of the support leg and the load-bearing plane. The support leg can then be lifted into a retracted position, aligned along the side wall of the hull without any risk of damaging the latter.

According to other optional characteristics of the load-bearing wing:

- the articulated connection may be a pivot connection whose axis is perpendicular to said longitudinal axis of said first support leg,
- said first support leg may be mounted pivotably about an axis of rotation perpendicular to the longitudinal axis of the hull of the watercraft enabling said first support leg to pivot and fold back along said hull,
- the first load-bearing plane may have a center of hydrodynamic pressure located on said longitudinal axis of said first support leg, while the axis about which the articulated connection has a degree of freedom in rotation is offset in relation to said longitudinal axis of said first support leg and to said center of hydrodynamic pressure of the load-bearing plane,
- the first load-bearing plane may consist of two moving parts each acting together with the first support leg through said articulated connection having a degree of freedom in rotation about an axis perpendicular to the longitudinal axis passing through said ends of said first support leg, said articulated connection being arranged so that the two moving parts can fold opposite each other and parallel to the longitudinal axis of said first support leg when the load-bearing wing is retracted,
- each moving part can act together with the first support leg through an articulated connection which 13 specific to it, each articulated connection having a degree of freedom in rotation about an axis perpendicular to the longitudinal axis passing through said ends of said first support leg, each of said articulated connections being arranged so that the two moving parts can fold opposite each other and parallel to the longitudinal axis of said first support leg when the load-bearing wing is retracted,
- each articulated connection connecting a moving part of the first load-bearing plane to the first support leg may be a pivot connection,
- the first support leg may comprise, on a median line of the base of its second end connected to said first supporting plane, a flap extending between the leading edge and the trailing edge of said load-bearing plane so that the two moving parts of said first load-bearing plane can rest on it when the load-bearing wing is deployed,
- the load-bearing wing may comprise a second support leg forming a first angle with the first support leg and supporting a second load-bearing plane inclined with respect to said first load-bearing plane at a second angle and connected to the first load-bearing plane, and:
  - one end of the second load-bearing plane can be connected to one end of the first load-bearing plane by a second articulated connection whose axis about which the articulated connection has a degree of freedom in rotation is substantially parallel to a transverse axis of the first load-bearing plane and to a transverse axis of the second load-bearing plane;
  - the second load-bearing plane may be connected to a first end of the second support leg by a third articulated connection whose axis about which the articulated connection has a degree of freedom in rotation is perpendicular to a longitudinal axis passing through the two ends of said second support leg and parallel to a transverse axis of said second load-bearing plane;

the second end of the second support leg may be connected to the first end of said first support leg through a fourth articulated connection whose axis about which the articulated connection has a degree of freedom in rotation is perpendicular to said longitudinal axes of said first and second support legs.

In this case said load-bearing wing connections may be arranged to allow said first and second load-bearing planes to be able to pivot about axes about which the first, second and third articulated connections have a degree of freedom in rotation respectively as soon as the lift of said first and second load-bearing planes becomes negative, folding against each other, and so that at the same time the first and second support legs can pivot about the axis about which the fourth articulated connection has a degree of freedom in rotation folding against each other in such a way that the first and second load-bearing planes and the first and second support legs can be aligned with each other parallel to the longitudinal axis of said first support leg, the axis about which the articulated connection or one of the articulated connections has a degree of freedom in rotation may be offset with respect to the longitudinal axis of the first or second support leg; said articulated connection may as a variant consist of a hinge comprising a virtual axis of rotation which is offset in relation to said longitudinal axis of said first or second support leg and in relation to the center of hydrodynamic pressure of said first or second load-bearing plane, the articulated connection may comprise a pin provided on the upper surface of the first load-bearing plane which is capable of being inserted into a complementary-shaped opening provided in the base of the first support leg located opposite to it.

The invention also relates to a watercraft comprising a hull acting together with a load-bearing wing according to said invention, advantageously through a pivot connection whose axis is substantially perpendicular to the longitudinal axis of said hull.

BRIEF DESCRIPTION OF THE SEVERAL VIEWS OF THE DRAWINGS

Other features and advantages of the invention will be apparent from a reading of the following description provided by way of an illustrative and non-limiting example with reference to the appended figures, which show.

DETAILED DESCRIPTION OF THE INVENTION

Figure 1A:
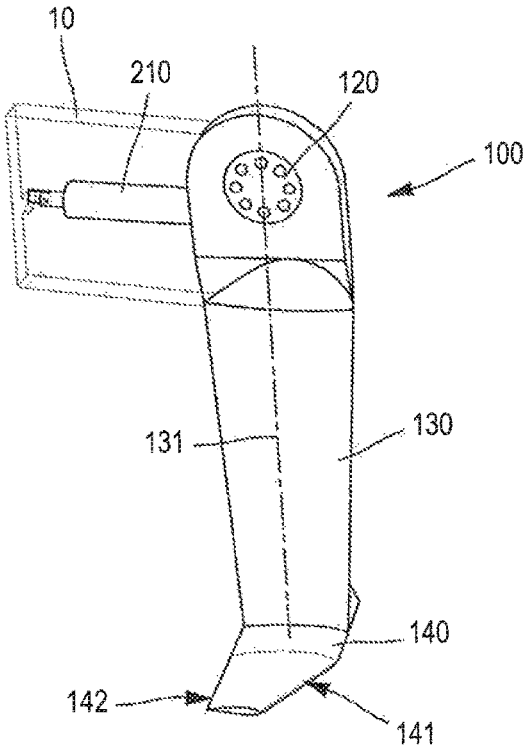
FIGS. 1A to 1C, diagrams of a load-bearing wing of the immersed type, of an upside-down "T" shape, in the deployed position, in a position at the start of folding and in a retracted position along the hull of a boat respectively.

In the remainder of the description the terms "bow" and "stern" are defined in relation to the hull of a boat and according to its direction of motion. Likewise the terms "upper" or "top" or "above" and "lower" or "bottom" or "below" are defined with respect to the hull and the surface of the water.

The leading edge of a load-bearing plane is defined as being the edge which first touches the fluid.

The trailing edge of a load-bearing plane, opposite the leading edge, is the edge to which the fluid flows.

The angle of incidence, also known as the angle of attack, is the angle that forms the cord or axis of the load-bearing plane with the direction of fluid flow. By "cord" or "axis of the load-bearing plane" is meant the straight line joining the leading edge to the trailing edge. Lift increases with the angle of incidence up to a maximum valise where detachment and loss of lift occurs. In order to have a positive incidence, and therefore positive lift, the leading edge is advantageously located above the trailing edge in relation to the flow of water. The asymmetry of the profile thus gives rise to higher speeds on the outside surface, that is to say the surface of the load-bearing plane facing upwards, and weaker on the inside surface, that is to say the surface of the load-bearing plane directed downwards. These differences in speed are reflected in higher pressures on the inside surface than on the outside surface and therefore lift which is directed upwards. A load-bearing wing may however have a symmetrical profile instead of an asymmetrical profile as described above.

Conventionally a load-bearing wing comprises at least one support leg and at least one load-bearing plane. A first upper end of the support leg is generally attached to a side wall of the hull of the watercraft and a second lower end is attached to the load-bearing plane. The straight line passing through the two ends of the support leg will be referred to below as the "longitudinal axis of the support leg".

Advantageously a load-bearing wing according to the invention comprises at least one articulated connection connecting the load-bearing plane to the support leg. This articulated connection comprises at least one degree of freedom in rotation about at least one axis perpendicular to the longitudinal axis of the support leg so that the load-bearing plane can fold or swing back parallel to the longitudinal axis of the support leg.

Preferably the articulated connection is a pivot connection whose axis is orientated perpendicular to the longitudinal axis of the support leg in such a way as to allow the load-bearing plane to pivot about the axis of the pivot connection and fold or swing back parallel to the longitudinal axis of the support leg.

Advantageously the support leg is also mounted on the hull so that it moves in rotation about an axis of rotation perpendicular to the longitudinal axis of the hull so that the support leg can pivot from a substantially vertical deployed position, that is to say perpendicular to the surface of the water and parallel to the height of the hull of a watercraft, to a substantially horizontal retracted position, that is to say parallel to the length of the side wall of the hull. As a variant the support leg may act together with the hull by means of a sliding connection, so that the load-bearing wing occupies a retracted position which might be in a substantially vertical lifted position.

As the load-bearing plane is folded parallel to the longitudinal axis of the support leg it does not interfere with the pivoting or lifting operation of the support leg into its retracted position, and does not risk jamming against or damaging the hull of the watercraft.

The invention applies to hydrofoils or load-bearing wings of any configuration. FIGS. 1A to 8B show examples of configurations of load-bearing wings in a non-limiting way, as well as simplified views of watercraft incorporating such wings.

In said figures the same reference numbers are used to identify the same elements.

Figure 1B:
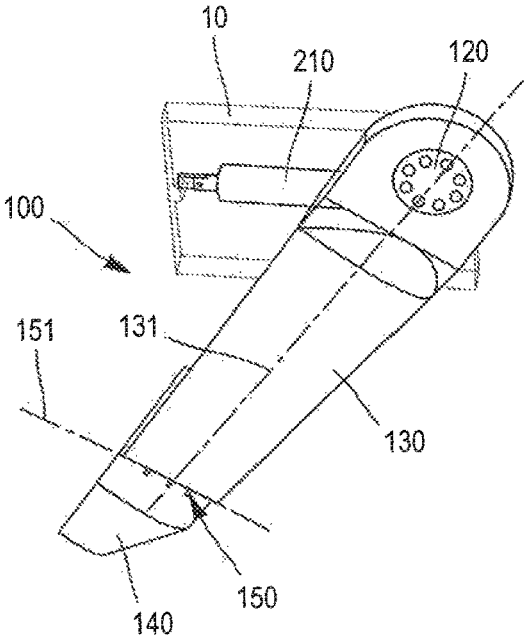
Figure 1C:
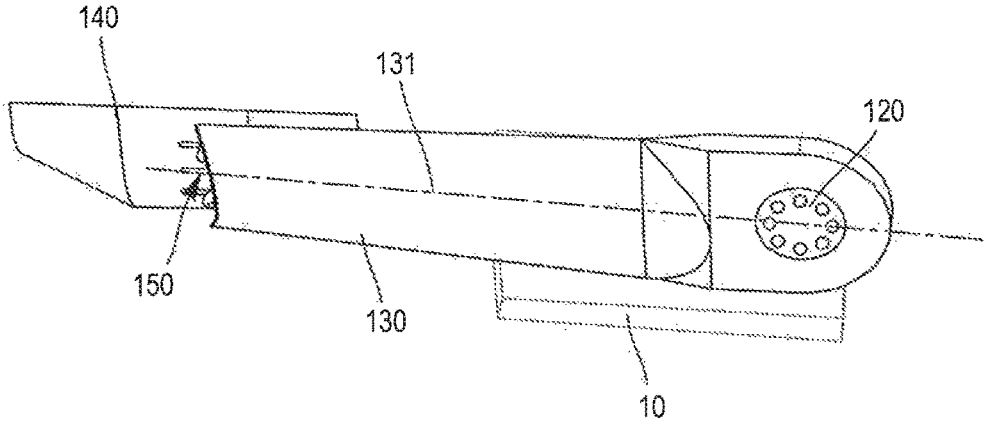
Figure 6A:
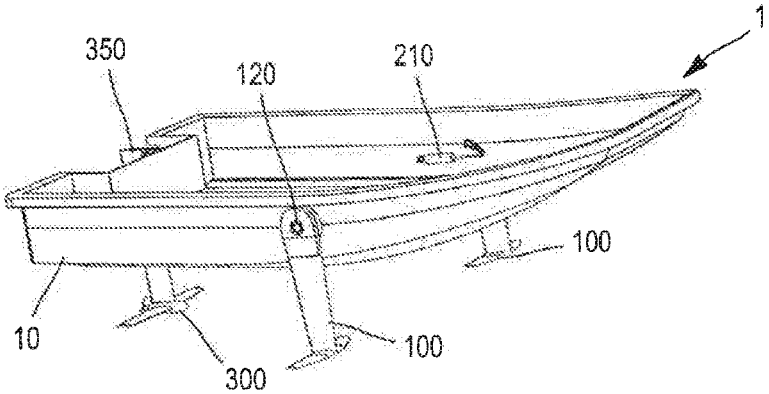
FIGS. 6A and 6B, perspective views of a watercraft whose hull forms two floating members each having an upside-down "T"-shaped load-bearing wing according to the invention, with said load-bearing wings in deployed or retracted positions.
Figure 6B:
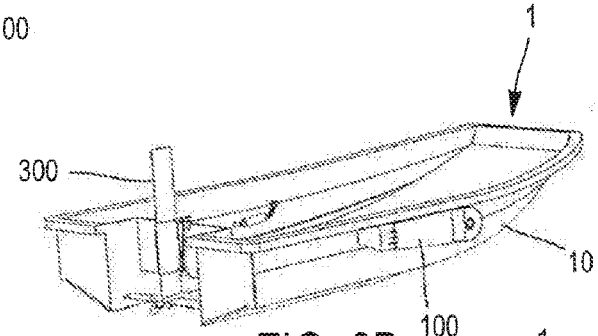

FIGS. 1A to 1C show diagrammatically more particularly an example of a load-bearing wing 100 of the immersed type, of an upside-down "T" shape, in its position of use, that is to say in a deployed position, in the position at the start of folding and in the retracted position along the hull of a watercraft, of which only a portion referenced 10 is shown in FIGS. 1A to 1C respectively. Such a craft 1 is described by way of non-limiting examples in connection with FIGS. 6A and 6B, 7A and 7B, or 8A and 8B. Hull 10 of said craft 1 forms two main floating members, one to port, the other to starboard. The outer wall of each floating member acts together with a load-bearing wing 100 according to the invention. As shown in FIG. 6A the two load-bearing wings 100 are deployed. As shown in FIG. 6B said wings 100 are retracted along said floating members. Craft 1 further comprises a thrust unit 300, for example comprising a motor-driven propeller, movably mounted on a vertical support acting together with hull 10 along a sliding connection 350 at the stern of craft 1 so that the immersed part of the thrust unit can be retracted. As a variant FIG. 8A describes a watercraft or vessel 1 of a single-hulled sailing boat type, the hull 10 of which has a load-bearing wing 100 according to the invention on the port and starboard sides in a deployed configuration to starboard, and in a retracted configuration to port.

Load-bearing wing 100 illustrated in FIGS. 1A to 1C comprises a support leg 130 connected to hull 10 of a boat on the one side, and to a load-bearing plane 140 on the other side ensuring that the load-bearing wing provides lift when the angle of incidence of the load-bearing plane is positive.

A stabilizer system, not shown in the figures, may also be provided to vary the lift coefficient of the load-bearing plane and thus control the rise of the load-bearing wing. Such a stabilizer system consists for example of causing the load-bearing plane to pivot slightly in relation to the support leg about an axis perpendicular to the longitudinal axis 131 of support leg 130 in such a way that load-bearing plane 140 is caused to pivot and leading edge 141 inclines to a greater or lesser extent in relation to trailing edge 142, and thus the angle of incidence is controlled. Likewise, according to other variants, the trailing edge of the load-bearing plane may be provided with a moving flap, or the load-bearing wing may be fitted with any other equivalent control device which makes it possible to vary the angle of incidence of the load-bearing plane.

For the sake of simplification, FIGS. 1A to 1C show a load-bearing wing whose angle of incidence, and therefore lift, is controlled by axis of rotation 120 perpendicular to hull 10, and about which the upper end of support leg 130 can pivot between a substantially vertical deployed position, that is to say perpendicular to the surface of the water, and a retracted position, along the side wall of hull 10 of the boat.

In the example illustrated in FIGS. 1A to 1C, load-bearing plane 140 is connected to support leg 130 through a pivot connection 150, the axis 151 of which is perpendicular to longitudinal axis 131 of support leg 130 so that load-bearing plane 140 can fold back parallel to longitudinal axis 131 of support leg 130.

Load-bearing plane 140 is mounted at the base of support leg 130 by means of pivot connection 150 which can by way of non-limiting examples rake the form of an axis of rotation or a hinge. Any other equivalent means may be used. When load-bearing plane 140 generates positive lift (positive angle of incidence) it then exerts pressure on the base of support leg 130 resulting in lifting of hull 100 of the boat.

Advantageously axis 151 of pivot connection 150 may not be centered on the center of hydrodynamic pressure of load-bearing plane 140, but may be offset in relation to that center. This asymmetry in construction then enables load-bearing plane 140 to fold back automatically along longitudinal axis 131 of support leg 130 when the lift is reversed, or more specifically when the direction of lift is reversed because of the pressure exerted on the outside surface which becomes larger on one side than the other in relation to axis 151 of the pivot connection. This pressure difference on the outside surface is indicated by two arrows on one side and one arrow on the other side of axis 151 of the pivot connection in FIG. 2B described below. However the center of hydrodynamic pressure of load-bearing plane 140, when the latter is in the deployed position, is preferably aligned with longitudinal axis 131 of support leg 130 to reduce the bending moment acting on said support leg 130 through the effect of the hydrodynamic pressure acting upon it, and thus ensure balanced lift.

Advantageously, support leg 130 may be mounted at its upper end in such a way that it moves in rotation about an axis 120 perpendicular to the side wall of hull 10. In FIGS. 1A, 1B, 2A, 2C, 5A, 3D, 6A, 7A, 8A and 8B the torque required to cause support leg 130, 230 to pivot about its axis of rotation 120, 220 is illustrated diagrammatically by a hydraulic jack 210 connected to a crank lever 211 (see in particular FIGS. 5A and 5D). However there are many other equivalent, solutions which allow the support leg to be pivoted about its axis 120, 220, among which a rotary actuator, or a rigging system operated for example by the halyards, may be mentioned by way of non-limiting examples.

Thus, when support leg 130 begins to pivot about its upper axis of rotation 120 the angle of incidence decreases progressively until the lift reverses and becomes negative. The resulting reverse force which then acts on the outside surface of load-bearing plane 140 (shown by the arrows in FIG. 2B described below) then causes load-bearing plane 130 to fold into a position substantially parallel to longitudinal axis 131 of support leg 130, as indicated in FIG. 1B. Thus as soon as load-bearing plane 140 is in alignment with longitudinal axis 131 of support leg 130 the latter can then be completely retracted into a raised position aligned along the side wall of hull 10 by pivoting about its axis of rotation 120 as described in FIGS. 1C and 6B. The load-bearing wing is then stowed alongside hull 10 without touching or damaging it. Advantageously said hull 10 may comprise a box or housing designed to receive the folded wing and thus protect said wing against any impact, or furthermore to contribute to the esthetics of hull 10 of craft 1.

Preferably the load-bearing wing is stowed in such a way that its total thickness e does not give rise to any significant increase in the maximum beam of hull 10 of the boat. Advantageously such a thickness e will be intended not to exceed the thickness of a fender or a dock fender positioned alongside boats when mooring, or also that of a rubbing strake. Thus the boat can moor normally alongside a conventional quay without being penalized by the dimensions of the retracted load-bearing wings.

With regard to FIGS. 1C and 6B, load-bearing plane 140 is folded back substantially parallel to longitudinal axis 131 of support leg 130 and faces towards hull 10 of the boat. However, depending on the space available between hull 10 and support leg 130, the load-bearing plane may also be folded back in the opposite direction, that is to say outwards in relation to the hull. For this the axis of the pivot connection will be offset on the other side in relation to the longitudinal axis of the support leg.

Figure 2A:
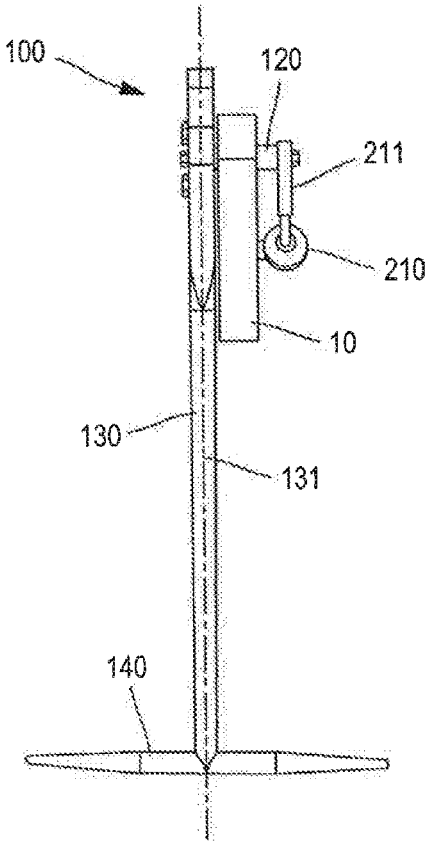
FIGS. 2A to 2C, diagrams of one embodiment of the pivot connection between the support leg and the load-bearing plane of the load-bearing wing in FIGS. 1A to 1C, when the load-bearing plane is in the deployed, semi-folded and completely folded positions respectively.
Figure 2B:
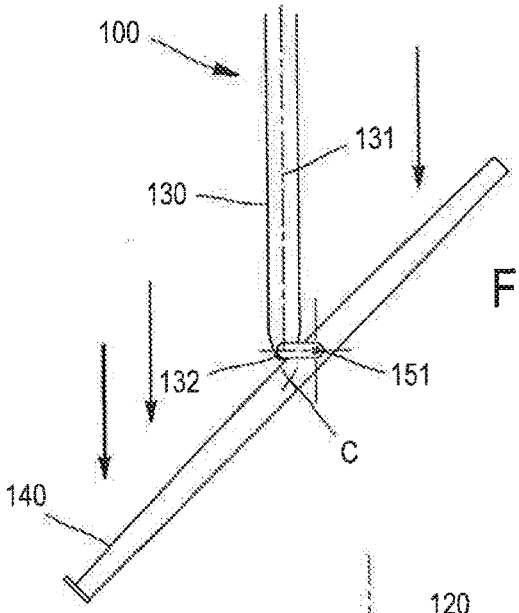
Figure 2C:
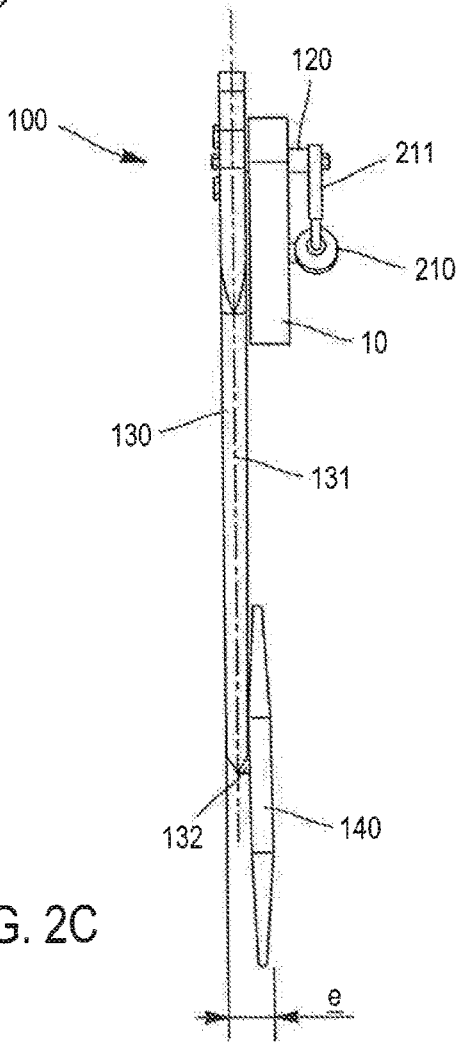

The pivot connection between load-bearing plane 140 and support leg 130 may for example take the form of an offset axis of rotation as illustrated in FIGS. 2A to 2C, which show the load-bearing wing in FIGS. 1A to 1C from the front, that is to say the view from the bow of the hull of a boat.

The diagram in FIG. 2B more particularly illustrates load-bearing plane 140 while it is being folded, more specifically in the process of being folded back against support leg 130. This diagram offers a good understanding of the principle according to which axis 151 of pivot connection 150 is offset laterally with respect to longitudinal axis 131 of support leg 130. Base 132 of support leg 130 is in fact cranked and rotation axis 151 forming the axis of pivot connection 150 is then located at the end of crank 132. The center of hydrodynamic pressure C of load-bearing plane 140 is aligned with longitudinal axis 131 of the support leg to reduce the bending moment on support leg 130 when the load-bearing wing is in the deployed position, thus ensuring balanced lift. As a consequence rotation axis 151 is offset in relation to the center of hydraulic pressure C of load-bearing plane 140 so that when the angle of incidence is reduced to the point that lift is reversed, the pressure exerted, which becomes stronger on the outside surface than on the inside surface of load-bearing plane 140, becomes stronger on one side of axis 151, where the surface area of the outside surface is greater than that of the other, because of this asymmetry, which then causes load-bearing plane 140 to pivot about axis 151 and fold parallel to longitudinal axis 131 of support leg 130 as indicated in FIG. 2C. The pressure difference acting on the outside surface and on either side of rotation axis 151 is represented by two arrows on one side and one arrow on the other side in the diagram in FIG. 2B.

Figure 3A:
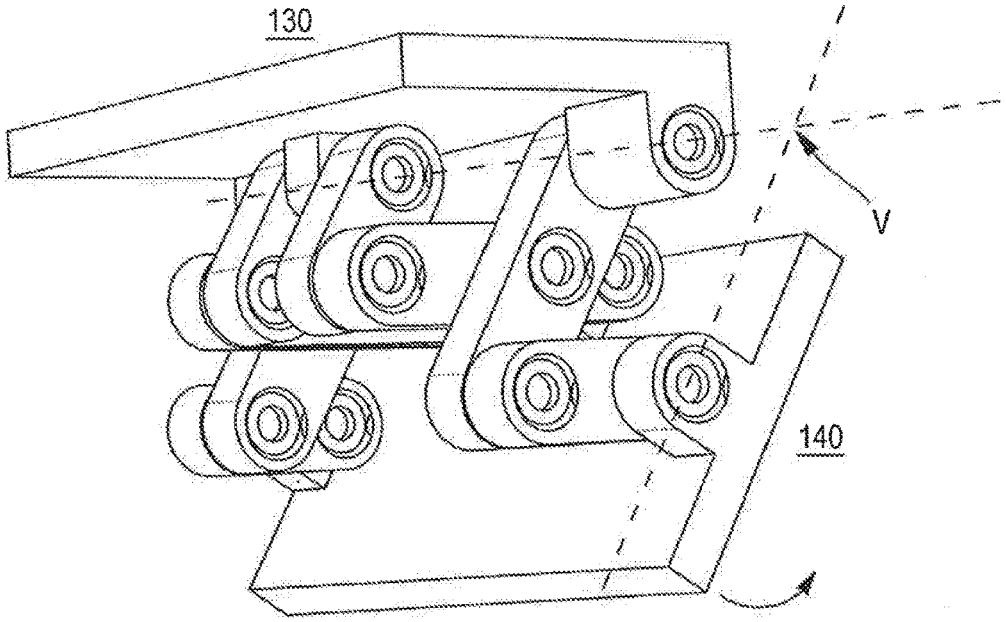
FIGS. 3A and 3B, diagrams of two other embodiments of a pivot connection in the form of a hinge.

According to another embodiment, articulated connection 150 between load-bearing plane 140 and support leg 130 may take the form of a hinge, as illustrated in FIG. 3A. In this case the hinge comprises an articulated system of connecting rods by means of which the hinge is deployed between 0 and 90° about a virtual axis projecting from a point V which is offset in relation to longitudinal axis 131 of support leg 130 and the center of pressure C of load-bearing plane 140.

Other hinge geometries may be suitable for achieving the same result, consisting of offsetting rotation axis 151 of the articulated connection, advantageously a pivot connection, in relation to longitudinal axis 131 of support leg 130 and the center of hydrodynamic pressure C of load-bearing plane 140.

Figure 3B:
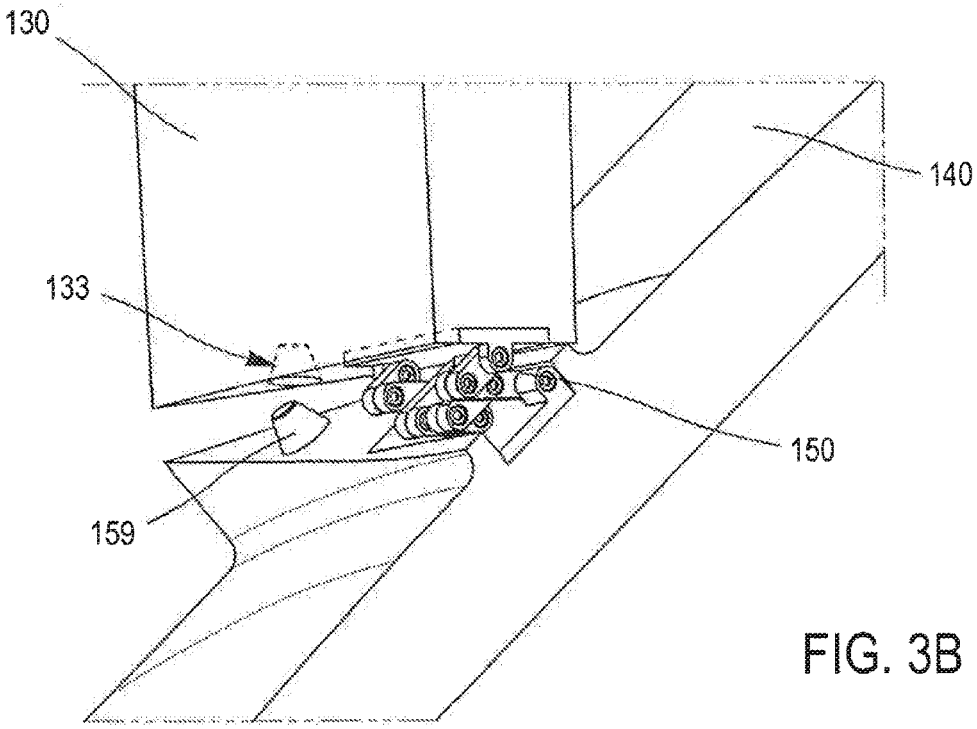

FIG. 3B diagramatically illustrates the same hinge as in FIG. 3A forming an articulated connection between load-bearing plane 140 and support leg 130 when the wing is in an intermediate position, that is to say between a deployed functioning position and a folded position.

A pin 159, for example of tapering shape, may also be provided on the upper surface of load-bearing plane 140 to be inserted into a complementary-shaped opening 133 provided in the base of support leg 130 in order to hold the two parts (load-bearing plane and support leg) firmly together, to make them secure and also to relieve the hinge of some of the load placed upon it. According to one variant embodiment the pin and the complementary opening may be reversed, that is to say that the pin may be located on the base of the support leg and the complementary opening on the upper surface of the supporting plane, facing the pin.

In a variant embodiment it is possible to envisage that the support leg is not automatically retracted when the load-bearing plane folds. It may in fact serve as a daggerboard, for example in a sailing boat, when it is running before the wind. Such a board located on the lee side, which is known in English as a "leeboard", thus enables the sailing boat to hold its course.

The various forms of articulated connection which have just been described may advantageously be fitted to all configurations of retractable load-bearing wings according to the invention.

Figure 4A:
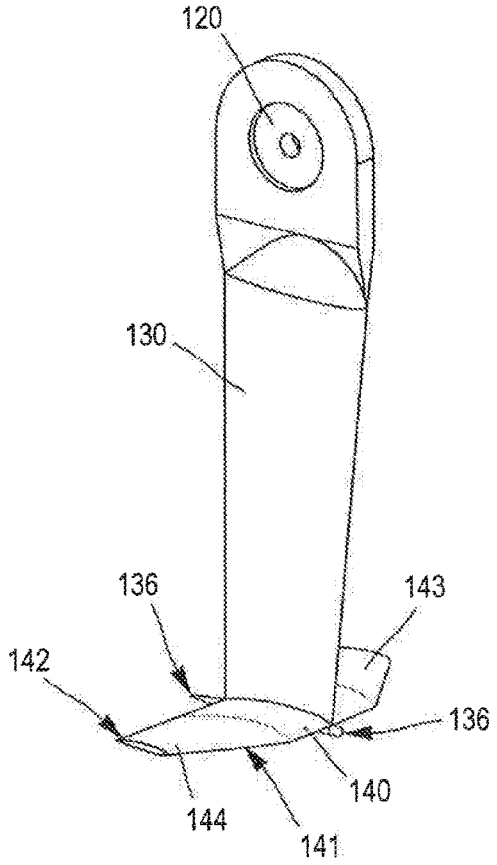
FIGS. 4A to 4C, diagrams of a load-bearing wing of the immersed type, of an upside-down "T" shape, whose load-bearing plane comprises two parts which are movable about a pivot connection, in the deployed position, in a position at the start of folding and in a retracted position along the side wall of the hull of a boat respectively.
Figure 4B:
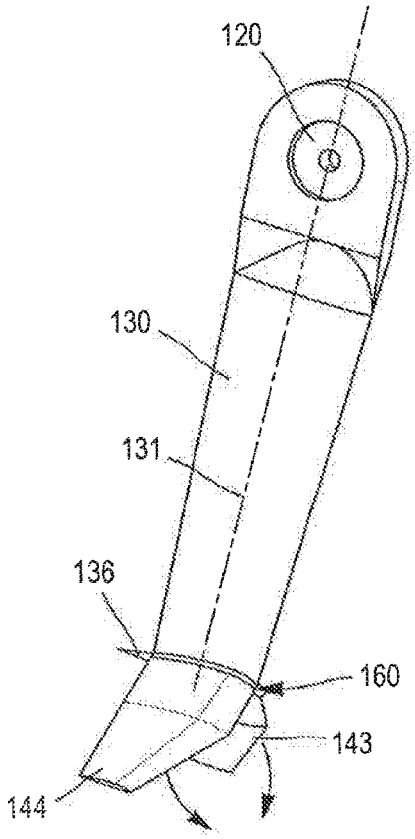
Figure 4C:
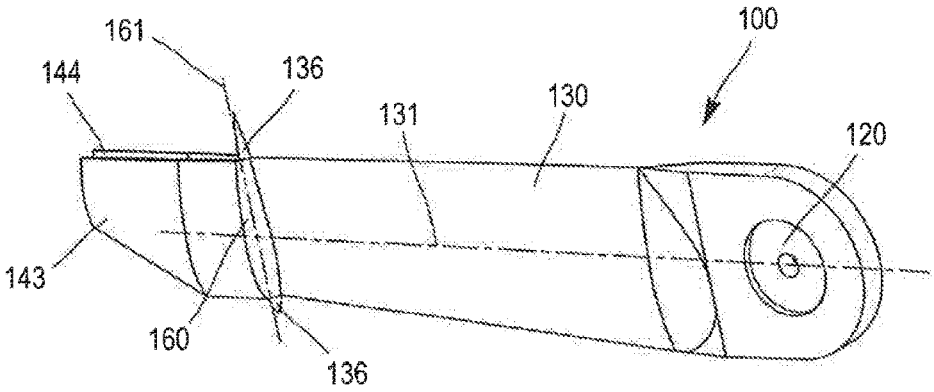
Figure 8A:
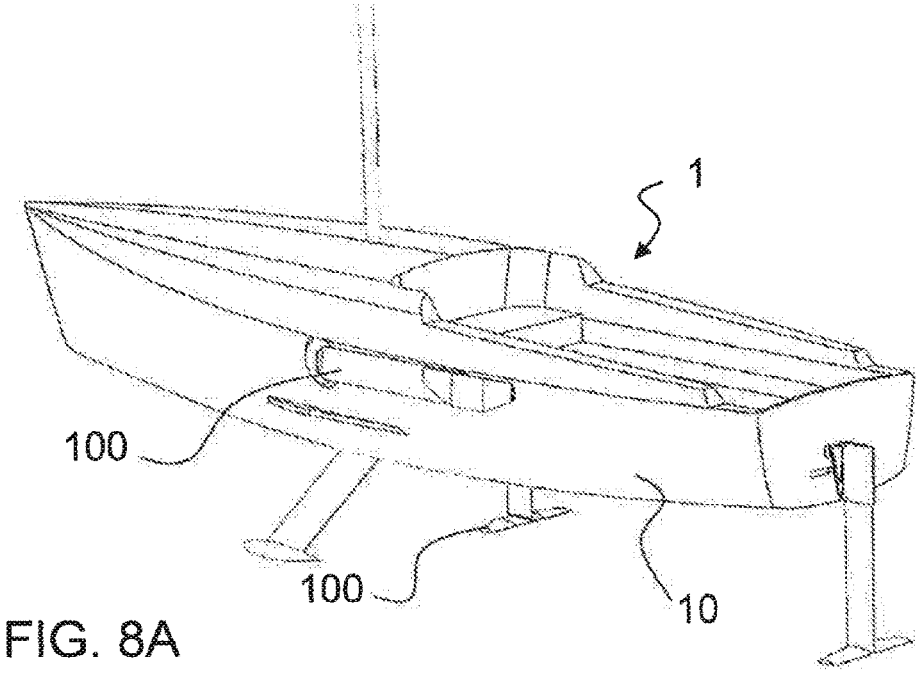
FIGS. 8A and 8B, perspective views of two arrangements of the same watercraft of the sailing boat type, the hull of which comprises upside-down "T"-shaped load-bearing wings and load-bearing wings of the surface-piercing type according to the invention respectively on its sides.
Figure 8B:
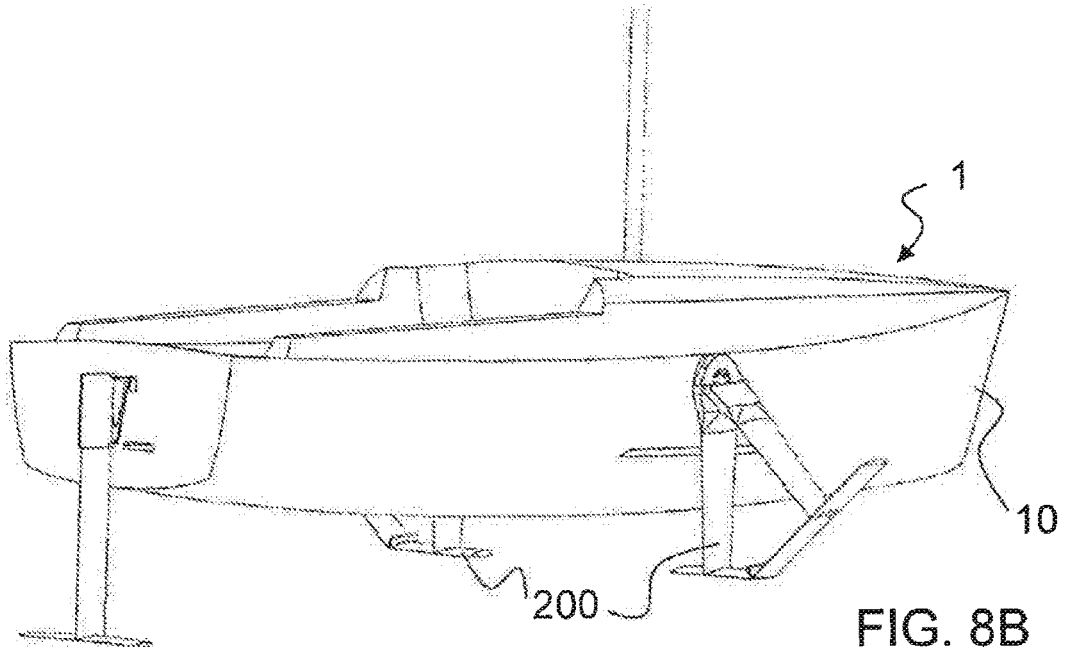

FIGS. 4A to 4C show diagrammatically a load-bearing wing of the immersed type, of an upside-down "T" shape, in a deployed position, a position in which folding begins and in a retracted position along the hull of a boat respectively, such as by way of a non-limiting example the motor-driven craft 1 described in connection with FIGS. 6A and 6B, the load-bearing plane 140 of which is divided into two moving parts referenced 143, 144, or again sailing boat 1 described in connection with FIGS. 8A and 8B. Moving parts 143, 144 of load-bearing plane 140 are connected to support leg 130 by means of at least one articulated connection 160 such as, advantageously but not limited to, a pivot connection.

Each part 143, 144 can then pivot about its own articulated connection or about just one articulated connection common to the two parts 143, 144. FIGS. 4A to 4C illustrate the advantageous situation of a single pivot connection 160 common to the two parts of the load-bearing plane. The variant according to which each moving part can fold along the longitudinal axis of the support leg, by pivoting about its own pivot connection, is not illustrated, as the principle of operation is the same.

The two moving parts 143, 144 pivot about an axis 161 centered on the base of support leg 130 perpendicular to longitudinal axis 131 of support leg 130 so that the two parts 143, 144 fold along longitudinal axis 131 of support leg 130 through a rotational movement in directions opposite each other about axis 161. Movement of the two parts 143, 144 is illustrated in the diagram in FIG. 4B by arrows having convergent directions of rotation.

Preferably a flap 136 is located on a median line of the base of support leg 130 in the direction of the profile of the load-bearing plane, that is to say extending between leading edge 141 and trailing edge 142. Such a flap 136 allows the two moving parts 143, 144 to rest on it under the effect of the pressure acting upon the inside surface when the lift is positive, and thus to prevent them rising above their substantially horizontal deployed positron in relation to the surface of the water.

Preferably flap 136 has a tapered profile in particular on the trailing edge, so as to reduce drag.

The functioning of a load-bearing wing described in connection with FIGS. 4A to 4C is identical to the first embodiment illustrated in FIGS. 1A to 1C, comprising a one-piece load-bearing plane mounted pivotably on the support leg, with the exception of the fact that the two parts 143, 144 of the load-bearing plane pivot in opposite directions. Thus they fold back into a position substantially parallel to longitudinal axis 131 of support leg 130 in an extension of the latter. Once the two parts 143, 144 of load-bearing plane 140 are folded back along longitudinal axis 131 of support leg 130, support leg 130 can be folded back completely, by rotation about its axis 120 located at its upper end so that the load-bearing wing is folded and retracted along the side wall of the hull of the boat.

FIG. 4A shows load-bearing plane 140 deployed in its working position, that is to say with its two parts 143, 144 horizontal and perpendicular to longitudinal axis 131 of support leg 130. In this position load-bearing plane 140 provides lift which raises the hull of a boat. FIG. 4B shows the start of folding of the load-bearing wing. When support leg 130 begins to pivot about its axis of rotation 120 perpendicular to the hull, the angle of incidence falls until the lift of load-bearing plane 140 reverses and becomes negative. The two parts then begin to fold back under the effect of the pressure acting on the outside surface, becoming larger than that acting on the inside surface of load-bearing plane 140. At the same time as the two parts 143, 144 of load-bearing plane 140 fold parallel to longitudinal axis 131 of support leg 130, the latter continues its pivoting movement about its axis of rotation 120 and thus rises along the side wall of the hull until it is housed in a retracted position parallel to the side wall of the hull as indicated in FIG. 4C.

Figure 7A:
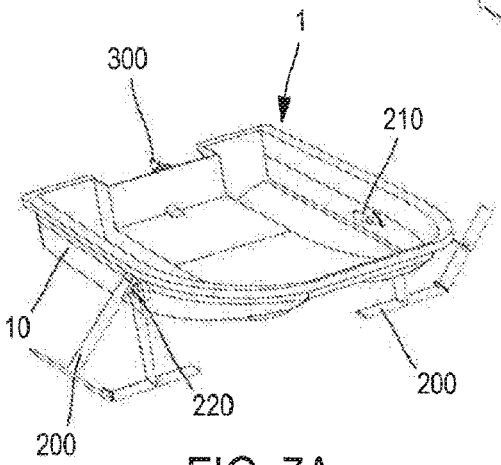
FIGS. 7A and 7B, perspective views of a motor-driven watercraft whose hull forms two floating members each having a load-bearing wing of the surface-piercing type according to the invention, with said load-bearing wings in deployed or retracted positions.
Figure 7B:
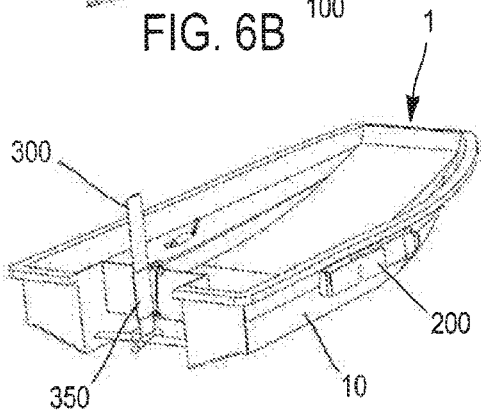

FIGS. 5A to 5D illustrate another embodiment of the retractable load-bearing wing according to the invention. The load-bearing wing illustrated in these figures is a load-bearing wing of the surface-piercing type. FIGS. 5A to 5D show diagrammatically more particularly a portion of hull 10 of a boat seen in perspective and fitted with two load-bearing wings 200 of the surface-piercing type, facing each other, at different stages in their retraction, respectively in the deployed position, at the start of folding, in the folded position and in the retracted position. FIGS. 7A and 7B also illustrate a motor-driven craft 1 whose hull 10 and thrust unit 300 are similar to those described in connection with craft 1 according to FIGS. 6A and 6B. The load-bearing wings are in a deployed configuration or position in FIGS. 5A and 7A. They are in their retracted configuration or position in FIGS. 5D and 7B. Likewise FIG. 8B describes a craft 1, of the sailing boat type, of which hull 10 has a pair of load-bearing wings 200 in a deployed configuration.

In the case of surface-piercing load-bearing wings the lift of the wing is proportional to the immersed surface area. The wing rises and falls until the lift from the load-bearing plane is the same as the weight applied to it at a given speed.

In accordance with the invention a load-bearing wing or hydrofoil may comprise a plurality of articulated connections, or advantageously pivot connections such as described above, in order to allow it to fold and then pivot backwards and upwards in a retracted position along the side wall of hull 10, so as not to significantly increase the maximum beam of the hull.

It should be noted that the load-bearing wing is stabilized in elevation as a result of the hydrodynamic lift created by the load-bearing plane, but when the lift is reversed and becomes negative the load-bearing wing advantageously folds back automatically because of the fact that the pressure acting on the load-bearing plane and in particular on its outside surface reverses.

In this embodiment the load-bearing wing of the piercing type comprises a first lower load-bearing plane 240 supported by a first support leg 230. It also comprises a second load-bearing plane 280 supported by a second support leg 260. The two support legs 230, 260 are connected together and the two load-bearing planes 240, 280 are also connected together. Support legs 230 and 260 form an angle $\alpha$ between them, such that first support leg 230 mounted so as to move in rotation about an axis 220 perpendicular to hull 10 of the boat is substantially vertical in the deployed position, while second support leg 260 is inclined in relation to first support leg 230. Likewise second supporting plane 280, which is perpendicular to second support leg 260 in the deployed position is inclined by an angle $\beta$ in relation to first load-bearing plane 240. Load-bearing wing 200 is supported by substantially vertical first support leg 230 which is attached to hull 10 so that it can move in rotation about an axis of rotation 220 perpendicular to the longitudinal axis of the hull.

Advantageously first load-bearing plane 240 acts together with first support leg 230 through a first articulated connection, for example in the form of a pivot connection 250 whose axis is perpendicular to the longitudinal axis 231 of said first support leg 230. As for second load-bearing plane 280, this acts together with an end of first load-bearing plane 240 through a second articulated connection, for example in the form of a pivot connection 281, the axis of which is parallel to a transverse axis of first load-bearing plane 240 and to a transverse axis of the second load-bearing plane. The transverse axis of one load-bearing plane, also referred to as the cord, connects the leading edge to the trailing edge of a load-bearing plane. Second load-bearing plane 280 further acts together with second support leg 260 through a third articulated connection, for example in the form of a pivot connection 282 whose axis is perpendicular to a longitudinal axis passing through the two ends of said second support leg 260 and parallel to the transverse axis of second load-bearing plane 280. Finally the second end of second support leg 260 acts together with a first end of said first support leg 230 through a fourth articulated connection, for example in the form of a pivot connection 270 whose axis is perpendicular to longitudinal axes 231, 261 of first and second support legs 230, 260 and parallel to the axis of first pivot connection 250 between first supporting plane 240 and first support leg 230. When the lift of said load-bearing planes 240, 280 reverses and becomes negative, for example as a result of inclination of first support leg 230 about its axis of rotation 220 perpendicular to the hull, or as a result of use of the moving flap(s) on the trailing edge(s) of the load-bearing plane(s) for example, the pressure acting on the surfaces of the load-bearing planes is reversed and becomes larger on the outside surface than on the inside surface.

Figure 5A:
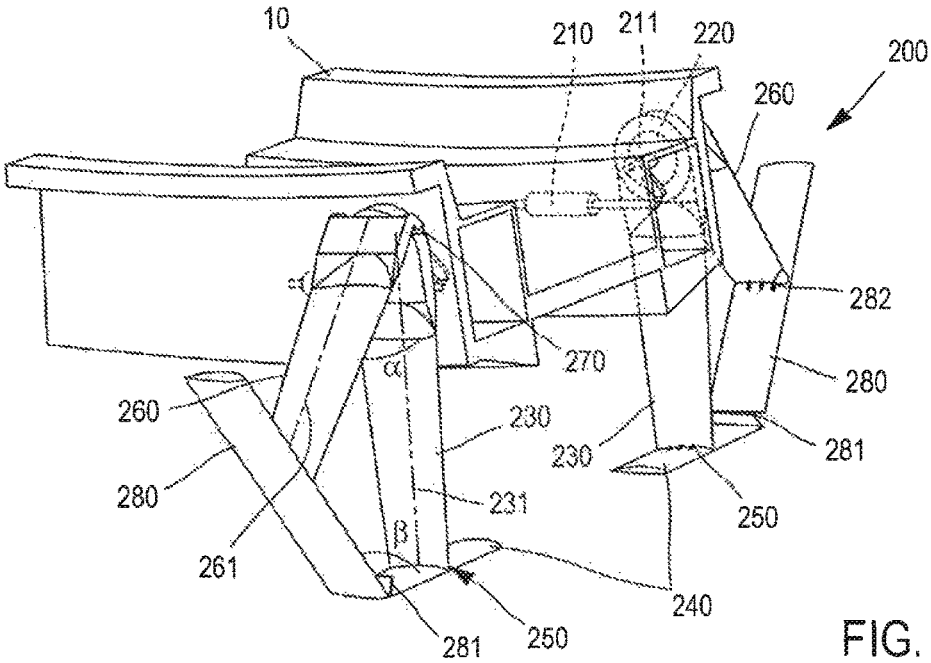
FIGS. 5A to 5D, perspective diagrams in cross section of a boat hull fitted with two load-bearing wings of the surface-piercing type, facing each other, at different stages in their retraction between a deployed position and a retracted position.
Figure 5B:
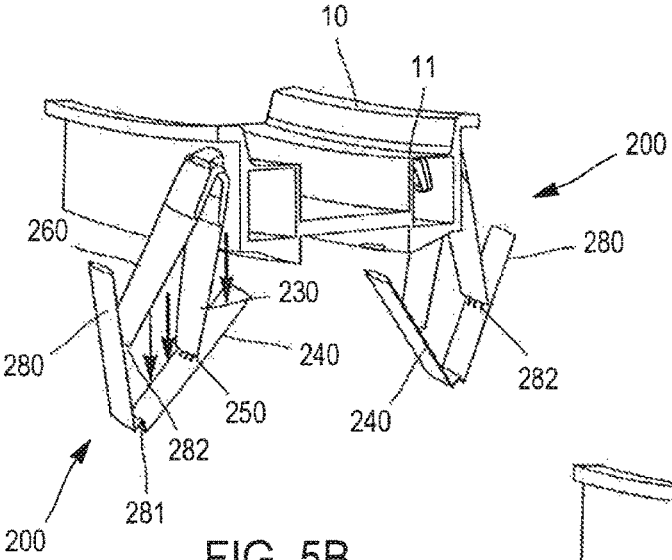
Figure 5C:
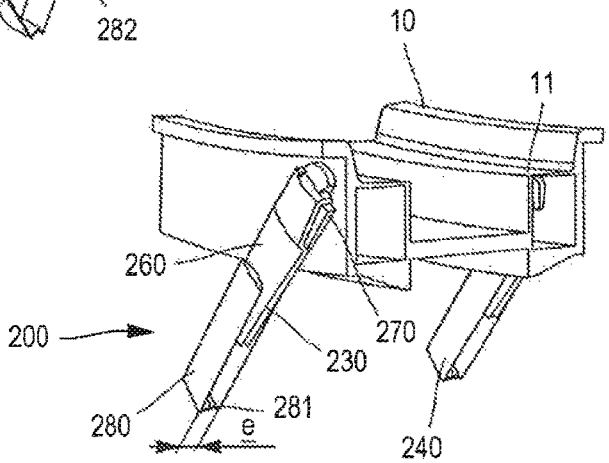
Figure 5D:
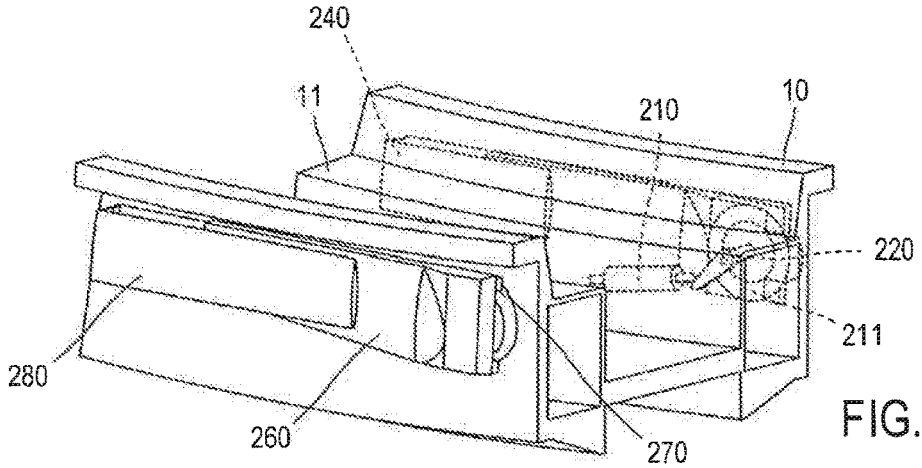

In connection with the non-limiting example described in FIGS. 5A to 5D, advantageously the axes of first and third pivot connections 250, 282 between each load-bearing plane 240, 280 and each support leg 230, 260 respectively can be advantageously offset towards the free ends of the load-bearing planes so that the pressure exerted on the outside surfaces of the load-bearing planes located between support legs 230, 260 is greater than that acting on the external surfaces located on either side of the support legs. This stronger pressure between the support legs also acts on second pivot connection 281 connecting the two load-bearing planes. The acting pressure then forces the two load-bearing planes to fold towards each other, as indicated by the start of folding of the load-bearing wing illustrated in FIG. 5B. The pressure difference acting on the outside surfaces of the load-bearing planes on either side of the support legs is represented by a different number of arrows in FIG. 5B, the stronger pressure being represented by a larger number of arrows. The two load-bearing planes 240, 280 then in their movement draw along support legs 230, 260 which come together pivoting about the axis of fourth pivot connection 270 as indicated in FIG. 5C. Load-bearing planes 240, 280 and support legs 230, 260 are then all aligned with each other and their dimensions on either side of the hull amount to the sum e of the thicknesses of the support legs and the load-bearing planes. The load-bearing wing folded back in this way can then be retracted along the side wall of hull 10, by pivoting first support leg 230 about its axis of rotation 220. FIG. 5D thus describes load-bearing wing 200 in the retracted position. The same applies in FIG. 7B, in which craft 1 includes two load-bearing wings 200, of which only the wing on the starboard side can be seen, in the retracted configuration.

FIGS. 1A to 1C, 5A and 3D represent a transparent portion of hull 10 so as to show the different elements of load-bearing wings 200 and the system 210, 211 for controlling pivoting of support leg 230 about its axis of rotation 220. This control system is preferably located in a box or housing 11 located within hull 10.

The embodiment which has just been described with regard to FIGS. 5A to 5D provides that the load-bearing planes are folded back along support legs 230, 260 on either side of these legs. In another embodiment it is possible to provide that they be folded back between the two support legs 230, 260. In this case the axes of the first and third pivot connections 250, 282, between each load-bearing plane 240, 280 and each support leg 230, 260, respectively are advantageously offset in the other direction, that is to say towards the area of the load-bearing planes located between the support legs. Thus when the lift becomes negative the pressure acting on the outside surfaces of the load-bearing planes located on either side of support legs 230, 260 is greater than the pressure acting on the outside surfaces located between the support legs. This stronger pressure on either side of support legs 230, 260 then forces the two load-bearing planes 240, 280 to fold back towards each other in a downward movement, while second connection 281 pivots about its axis while rising between support legs 230, 260. The two load-bearing planes 240, 280 fold against each other and in their movement then draw along support legs 230, 260 which pivot about the axis of fourth pivot connection 270 and come to be folded back on either side of the load-bearing planes. The load-bearing wing folded back in this way can then be retracted along the side wall of the hull by first support leg 230 pivoting about its axis of rotation 220.

In FIGS. 5A, 5D and 7A control of the pivoting of load-bearing wing 200 is represented by a hydraulic jack 210 which causes axis of rotation 120, 220 to rotate through a crank lever 211. However, this illustration is but one illustrative example and is in no respect limiting. Other equivalent means may be used to cause the folded load-bearing wing to pivot about its axis of rotation 120, 220, such as by way of non-limiting examples a rotary actuator or rigging systems activated by the halyards.

The shape of the load-bearing wing, in other words the relative positions of the constituent elements of the assembly of said load-bearing wing are held in their deployed positions of use by the hydrodynamic force applied to the load-bearing plane or planes. As soon as the angle of incidence decreases, the lift from the load-bearing plane or planes also decreases. The decrease in the angle of incidence is represented in FIGS. 1A to 5D by slight rearward pivoting of support leg 130, 230 about its axis of rotation 120, 220. The angle of incidence may however be controlled by other equivalent means such as by way of non-limiting examples moving flaps on the trailing edge or slight pivoting of the load-bearing plane in relation to the support leg to vary the inclination of the leading edge in relation to the trailing edge. As the lift decreases it ends up by reversing and becoming negative. In this case as soon as the lift is negative the load-bearing wing folds naturally and automatically because of the pressure acting on the outside surface of the load-bearing plane or planes.

When the assembly is folded, that is to say when the load-bearing plane is aligned along the support leg, it can easily be lifted, by pivoting about its axis of rotation, into a position which does not significantly increase the maximum beam of the boat's hull.

The various embodiments that have just been, described make it possible for load-bearing plane(s) 140, 240, 280 to fold automatically as soon as the lift becomes negative and draw support legs 230, 260 together during their movement.

In a variant embodiment it is possible to envisage that folding of load-bearing plane or planes 140, 240, 260 may be driven by a motor-driven device (not shown in the figures) or merely manually by muscular strength. In this case the device makes it possible for folding to be forced when the pressure on the inside surface falls and is sufficiently low for it to be possible to apply a contrary force which will force the load-bearing plane or planes to fold along support leg or legs 130, 230, 260.

In accordance with the invention the load-bearing plane or planes of the load-bearing wing are therefore folded parallel to the longitudinal axis of the support leg or legs and the support leg or legs are pivoted about a single axis of rotation, rearwards and upwards in a retracted position along the hull. The invention applies to any existing type of configuration of load-bearing wings or hydrofoils, whether these load-bearing wings are of the piercing type or immersed type.

Although only embodiments using lateral outer load-bearing wings have been described in the description, the invention also applies to load-bearing wings which can be raised in a slot or recess made in the hull, for example in the positron of a centerboard. In this case the axis of rotation about which the support leg pivots is mounted on the hull, and more specifically on one of the side walls of said slot made in the hull.

The retractable load-bearing wing which has just been described can be fitted to any type of watercraft hull without the need to transform the hull. The wing folds up into a small space equivalent to the sum of the thicknesses of the support leg or legs and the load-bearing plane or planes, and can be retracted into a housing along the hull by means of which the maximum beam of the hull of said watercraft is not increased. The load-bearing wing is simple to manufacture because it only requires articulated connections, such as, advantageously but not limited to, pivot connections to assemble the different parts. It is also simple and quick to install on a hull because there is no need to alter its shape. It also folds and retracts in a very simple and quick way because folding of the load-bearing plane or planes takes place automatically when lift becomes negative.

As the assembly advantageously only uses one or more articulated or pivot connections it can be fitted to any type of load-bearing wing having different configurations. Only the number of articulated connections varies in relation to the configuration, and in particular in relation to the number of support legs and number of load-bearing planes.

The invention claimed is:

1. A retractable load-bearing wing fitted to a watercraft, said load-bearing wing comprising:

a first support leg, a first end of which acts together with the hull of the watercraft and a second end of which supports a first load-bearing plane, said load-bearing wing being characterized in that said first load-bearing plane and said first support leg act together through an articulated connection having a degree of freedom in rotation about an axis perpendicular to a longitudinal axis passing through said ends of said first support leg, enabling said load-bearing plane to fold parallel to said longitudinal axis; and a second support leg forming a first angle with the first support leg and supporting a second load-bearing plane inclined with respect to said first load-bearing plane at a second angle and connected to the first load-bearing plane, in which:

one end of the second load-bearing plane is connected to one end of the first load-bearing plane by a second articulated connection whose axis about which the articulated connection has a degree of freedom in rotation is substantially parallel to a transverse axis of the first load-bearing plane and to a transverse axis of second load-bearing plane, the second load-bearing plane is connected to a first end of the second support leg by a third articulated connection whose axis about which the articulated connection has a degree of freedom in rotation is perpendicular to a longitudinal axis passing through the two ends of said second support leg and parallel to a transverse axis of said second load-bearing plane, the second end of the second support leg is connected to the first end of said first support leg through a fourth articulated connection whose axis about which the articulated connection has a degree of freedom in rotation is perpendicular to said longitudinal axes of said first and second support legs, said articulated connections being arranged to allow said first and second load-bearing planes to pivot about axes about which the first, second and third articulated connections have a degree of freedom in rotation respectively as soon as the lift of said first and second load-bearing planes becomes negative, folding against each other, and so that at the same time the first and second support legs pivot about the axis about which the fourth articulated connection has a degree of freedom in rotation folding against each other in such a way that the first and second load-bearing planes and the first and second support legs are aligned with each other parallel to the longitudinal axis of said first support leg.

2. The load-bearing wing as claimed in claim 1, in which the articulated connection is a pivot connection whose axis is perpendicular to said longitudinal axis of said first support leg.

3. The load-bearing wing as claimed in claim 1, in which said first support leg is mounted pivotably about an axis of rotation perpendicular to the longitudinal axis of the hull of the watercraft enabling said first support leg to pivot and fold back along said hull.

4. The load-bearing wing as claimed in claim 1, in which the first load-bearing plane has a center of hydrodynamic pressure located on said longitudinal axis of said first support leg, while the axis about which the articulated connection has a degree of freedom in rotation is offset in relation to said longitudinal axis of said first support leg and to said center of hydrodynamic pressure of the load-bearing plane.

5. The load-bearing wing as claimed in claim 1, in which the first load-bearing plane consists of two moving parts each acting together with the first support leg through said articulated connection having a degree of freedom in rotation about an axis perpendicular to the longitudinal axis passing through said ends of said first support leg, said articulated connection being arranged so that the two moving parts fold opposite each other and parallel to the longitudinal axis of said first support leg when the load-bearing wing is retracted.

6. The load-bearing wing as claimed in claim 5, in which each moving part acts together with the first support leg through an articulated connection which is specific to it, each articulated connection having a degree of freedom in rotation about an axis perpendicular to the longitudinal axis passing through said ends of said first support leg, each of said articulated connections being arranged so that the two moving parts fold opposite each other and parallel to the longitudinal axis of said first support leg when the load-bearing wing is retracted.

7. The load-bearing wing as claimed in claim 5, in which each articulated connection connecting a moving part of the first load-bearing plane to the first support leg is a pivot connection.

8. The load-bearing wing as claimed in claim 5, in which the first support leg comprises, on a median line of the base of its second end connected to said first supporting plane, a flap extending between the leading edge and the trailing edge of said load-bearing plane so that the two moving parts of said first load-bearing plane rest on it when the load-bearing wing is deployed.

9. The load-bearing wing as claimed in claim 1, in which the axis about which the articulated connection or one of the articulated connections has a degree of freedom in rotation is offset with respect to the longitudinal axis of the first or second support leg or in which said connection consists of a hinge comprising a virtual axis of rotation which is offset in relation to said longitudinal axis of said first or second support leg and in relation to the center of hydrodynamic pressure of said first or second load-bearing plane.

10. The load-bearing wing as claimed in claim 9, in which the articulated connection comprises a pin provided on the upper surface of the first load-bearing plane which is capable of being inserted into a complementary-shaped opening provided in the base of the first support leg located opposite to it.

11. A watercraft comprising a hull, characterized in that said hull acts together with a load-bearing wing as claimed in claim 1.

12. The craft as claimed in claim 11, in which the hull acts together with said load-bearing wing through a pivot connection whose axis is substantially perpendicular to the longitudinal axis of said hull.

13. A watercraft comprising a hull, wherein said hull acting together with a retractable load bearing wing, said load-bearing wing comprising a first support leg, a first end of which acts together with the hull of the watercraft and a second end of which supports a first load bearing plane, wherein said first load bearing plane and said first support leg act together through an articulated connection having a degree of freedom in rotation about an axis perpendicular to a longitudinal axis passing through said ends of said first support leg, enabling said load-bearing plane to fold parallel to said longitudinal axis, and the watercraft comprising a thrust unit comprising a motor driven propeller, movably mounted on a vertical support, acting together with the hull along a sliding connection at the stern of the craft so that the immersed part of the thrust unit can be retracted; and wherein the first load-bearing plane has a center of hydrodynamic pressure located on said longitudinal axis of said first support leg, while the axis about which the articulated connection has a degree of freedom in rotation is offset in relation to said longitudinal axis of said first support leg and to said center of hydrodynamic pressure of the load-bearing plane.

14. A watercraft comprising a hull, the hull acting together with a retractable load bearing wing, the load-bearing wing comprising a first support leg, a first end of which acts together with the hull of the watercraft and a second end of which supports first load bearing plane, wherein said first load bearing plane and said first support leg act together trough an articulated connection having a degree of freedom in rotation about an axis perpendicular to a longitudinal axis passing through said ends of said first support leg, enabling said load-bearing plane to fold parallel to said longitudinal axis, and the watercraft comprising a thrust unit comprising a motor driven propeller, movably mounted on a vertical support, acting together with the hull along a sliding connection at the stern of the craft so that the immersed part of the thrust unit can be retracted;

wherein the first load-bearing plane consists of two moving parts, each acting together with the first support leg through said articulated connection having a degree of freedom in rotation about an axis perpendicular to the longitudinal axis passing through said ends of said first support leg, said articulated connection being arranged so that the two moving parts fold opposite each other and parallel to the longitudinal axis of said first support leg when the load-bearing wing is retracted; and wherein the first support leg comprises, on a median line of the base of its second end connected to said first supporting plane, a flap extending between the leading edge and the trailing edge of said load-bearing plane so that the two moving parts of said load-bearing plane rest on it when the load-bearing wing is deployed.

* * * * *